US011724360B2

(12) United States Patent
Kung

(10) Patent No.: US 11,724,360 B2
(45) Date of Patent: Aug. 15, 2023

(54) CHEMICAL MECHANICAL POLISHING SYSTEM AND METHOD OF USING

(71) Applicants: TAIWAN SEMICONDUCTOR MANUFACTURING COMPANY, LTD., Hsinchu (TW); TSMC NANJING COMPANY, LIMITED, Nanjing (CN)

(72) Inventor: Wen Yen Kung, Hsinchu (TW)

(73) Assignees: TAIWAN SEMICONDUCTOR MANUFACTURING COMPANY, LTD., Hsinchu (TW); TSMC NANJING COMPANY, LIMITED, Nanjing (CN)

( * ) Notice: Subject to any disclaimer, the term of this patent is extended or adjusted under 35 U.S.C. 154(b) by 272 days.

(21) Appl. No.: 16/910,978

(22) Filed: Jun. 24, 2020

(65) Prior Publication Data

US 2021/0370466 A1 Dec. 2, 2021

(30) Foreign Application Priority Data

May 29, 2020 (CN) ..... 202010476541.7

(51) Int. Cl.
*B24B 53/017* (2012.01)
*B24B 37/20* (2012.01)
*B24B 53/013* (2006.01)

(52) U.S. Cl.
CPC ..... *B24B 53/017* (2013.01); *B24B 37/20* (2013.01); *B24B 53/013* (2013.01)

(58) Field of Classification Search
CPC ..... B24B 53/017; B24B 37/20; B24B 53/013
USPC ..... 451/56, 41, 5, 8, 21, 414
See application file for complete search history.

(56) References Cited

U.S. PATENT DOCUMENTS 6,702,646 B1 * 3/2004 Gitis ..... B24B 49/04 451/21
7,040,954 B1 * 5/2006 McClatchie ..... B24B 49/18 451/5
2003/0027424 A1 * 2/2003 Paik ..... B24B 37/042 438/692
2005/0090185 A1 * 4/2005 Fujishima ..... B24B 53/017 451/6

(Continued)

FOREIGN PATENT DOCUMENTS

CN 10047994 C 4/2009
CN 101898327 12/2010
CN 105738320 7/2016

(Continued)

OTHER PUBLICATIONS

Office Action dated Apr. 6, 2021 for corresponding case No. TW 11020306070 (pp. 1-7).

*Primary Examiner* — Joel D Crandall
*Assistant Examiner* — Shantese L McDonald
(74) *Attorney, Agent, or Firm* — Hauptman Ham, LLP

(57) ABSTRACT

A method of conditioning a polishing pad includes receiving information on a roughness of the polishing pad from a first sensor. The method further includes conditioning the polishing pad using a conditioner. The method further includes detecting the roughness of the polishing pad following the conditioning. The method further includes repeating the conditioning in response to the detected roughness of the polishing pad being outside of a threshold roughness range.

20 Claims, 4 Drawing Sheets

(56) References Cited

U.S. PATENT DOCUMENTS

| | | | | |
|---|---|---|---|---|
| 2015/0170978 | A1* | 6/2015 | Chen | B24B 49/12<br>702/172 |
| 2018/0015590 | A1 | 1/2018 | Matsuo | |

FOREIGN PATENT DOCUMENTS

| | | | |
|---|---|---|---|
| CN | 109702650 | A | 5/2019 |
| CN | 111132802 | | 5/2020 |
| JP | 2012000741 | A | 1/2012 |
| JP | WO2016111335 | A1 | 10/2017 |
| TW | 399252 | B | 7/2000 |
| TW | 466153 | B | 12/2001 |

* cited by examiner

CHEMICAL MECHANICAL POLISHING SYSTEM AND METHOD OF USING

PRIORITY CLAIM

The present application claims priority to the China Patent Application No. 202010476541.7, filed May 29, 2020, which is incorporated herein by reference in its entirety.

BACKGROUND

Integrated circuits are formed using various processing steps. Some processing steps involve depositing dielectric layers or metal layers on a semiconductor wafer. The deposition processes result in non-planar surfaces, in some instances. The non-planar surfaces are polished to provide a more uniform surface for additional processing. In some instances, the polishing is performed by chemical mechanical polishing (CMP) which removes material from the non-planar surfaces to provide the more uniform surface and reduce a thickness of the semiconductor wafer.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
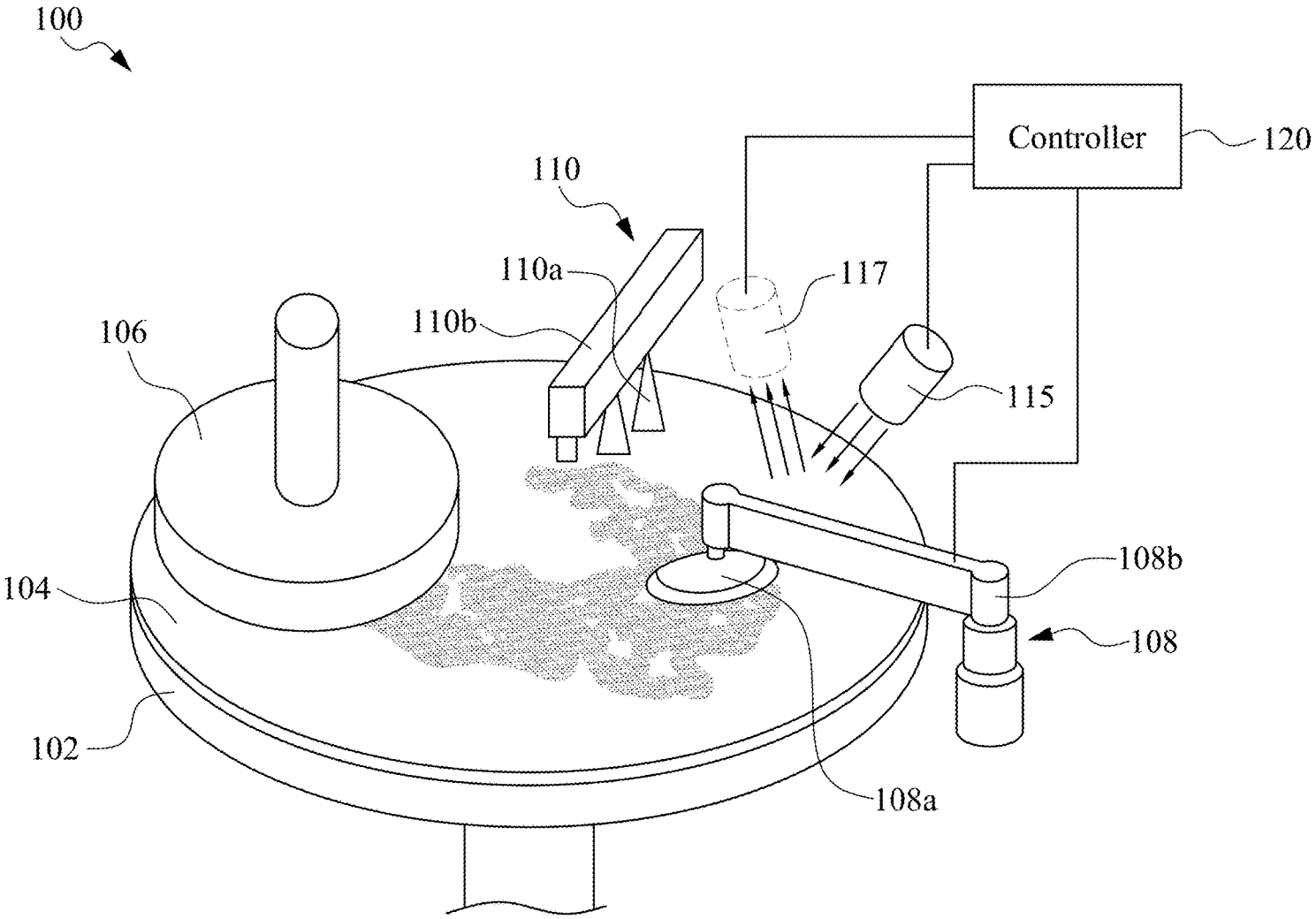
FIG. 1 is a diagram of a chemical mechanical polishing (CMP) system in accordance with one or more embodiments.

The following disclosure provides many different embodiments, or examples, for implementing different features of the provided subject matter. Specific examples of components, values, operations, materials, arrangements, or the like, are described below to simplify the present disclosure. These are, of course, merely examples and are not intended to be limiting. Other components, values, operations, materials, arrangements, or the like, are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 4A:
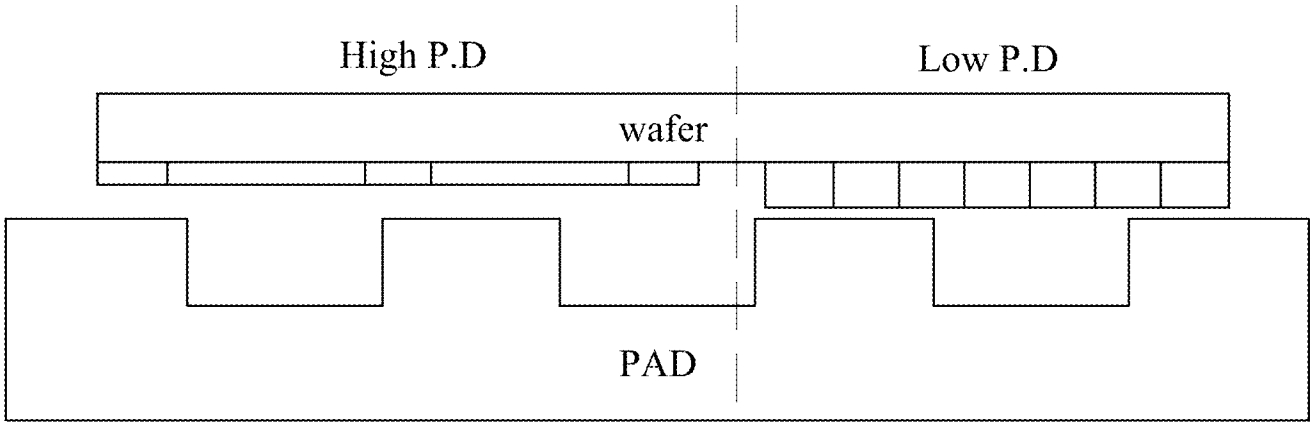
FIGS. 4A and 4B are cross sectional views of a polishing pad and a wafer in accordance with one or more embodiments.
Figure 4B:
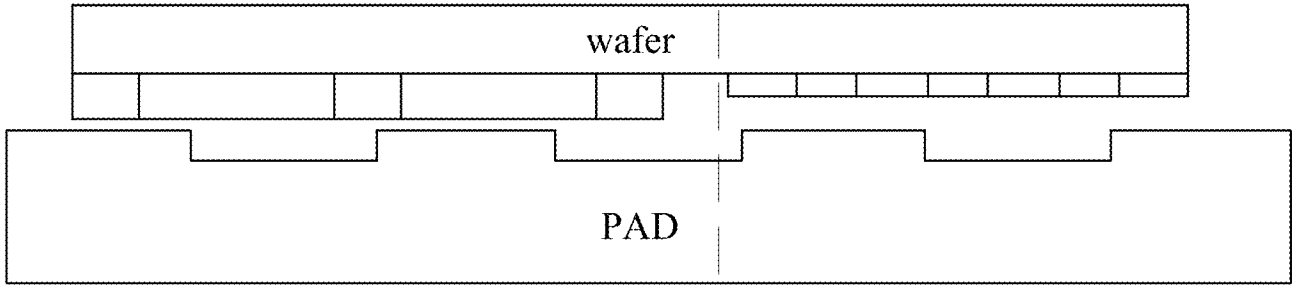

Chemical mechanical polishing (CMP) is used to planarize a surface of a semiconductor device during processing. Ideally, following a CMP process the surface of the semiconductor device is completely flat. However, multiple factors impact the performance of a CMP process during a manufacturing process. One of those factors is roughness of the polishing pad. Roughness of the polishing pad will impact polishing behavior of the CMP process based on different pattern densities. A pattern density is a density of features on a surface of a wafer. As the number of features per unit area increases, the pattern density also increases. In some instances, as a roughness of the polishing pad decreases below a threshold range, a ratio of a thickness for a low density area and a thickness for a high density area decreases to be less than a target range. For example, FIG. 4B includes a polishing pad having a roughness below the threshold range. Conversely, in some instances, as a roughness of the polishing pad increases to be above the threshold range, the ratio of the thickness for the low density area and the thickness for the high density area increases to above the target range. For example, FIG. 4A includes a polishing pad having a roughness above the threshold range. That is, a polishing pad having a surface roughness outside of the threshold range results in thickness variation across the wafer depending on the location of high pattern density (PD) regions and low pattern density regions.

According to some embodiments of the current description, monitoring the roughness of the polishing pad and controlling a pad conditioning process helps to reduce or avoid thickness variations across the wafer by controlling the polishing pad roughness to be within the threshold range. In some embodiments, a number of iterations of a conditioning process is controlled to help manage the polishing pad roughness. In some embodiments, a number of conditioning pads utilized in a conditioning process is controlled to help manage the polishing pad roughness. In some embodiments, a pressure or location of the conditioning pad is controlled to help manage the polishing pad roughness. By controlling the conditioning process, the roughness of the polishing pad is maintained within a threshold range.

As a polishing pad continues to polish wafers, the polishing pad is eventually degraded to the point where the polishing pad is no longer able to be restored to a roughness in the threshold range. If the polishing pad is replaced too often, then the cost of manufacturing increases because usable polishing pads are being replaced prematurely. In contrast, if the polishing pad is replaced too late, then wafers undergoing the CMP process using a polishing pad that should have been replaced will have increased thickness variation. As a result, the chances of the devices formed on the wafer being faulty increases. In some embodiments, a controller is used to determine when to replace the polishing pad in order to help reduce manufacturing costs and to reduce the risk of faulty devices on the wafer.

A CMP system uses a combination of chemical reactions and mechanical grinding to remove material from a surface of a semiconductor device. FIG. 1 is a diagram of a CMP system 100 in accordance with one or more embodiments.

CMP system 100 includes a platen 102 configured to rotate in at least one direction. A polishing pad 104 is provided on top of platen 102. A polishing head 106 is configured to support a wafer for processing using CMP system 100. Polishing head 106 is configured to adjust a pressure exerted on the wafer by polishing pad 104. CMP system 100 further includes a conditioner 108 configured to restore a roughness of polishing pad 104. CMP system 100 further includes a slurry delivery system 110 configured to deliver a slurry to polishing pad 104 to facilitate removal of material from the wafer. A sensor 115 is used to monitor the roughness of polishing pad 104. An optional sensor 117 is configured to receive light reflected from sensor 115, in some embodiments. A controller 120 is configured to receive information from sensor 115 or sensor 117 and to control conditioner 108 based on the received information.

CMP system 100 removes material from the wafer based on relative motion between polishing pad 104 and polishing head 106. A slurry introduced to polishing pad 104 by slurry delivery system 110 reacts with materials on the wafer and mechanical force exerted on the wafer by the polishing pad removes material from the wafer.

Platen 102 is configured to rotate in at least a first direction. In some embodiments, platen 102 is configured to rotate in more than one direction. In some embodiments, platen 102 is configured to be held stationary. In some embodiments, platen 102 is configured to have a constant rotational speed. In some embodiments, platen 102 is configured to have a variable rotational speed. In some embodiments, platen 102 is rotated by a motor. In some embodiments, the motor is an alternating current (AC) motor, a direct current (DC) motor, a universal motor, or another suitable motor. In some embodiments, platen 102 is configured to translate in one or more directions.

Platen 102 is configured to support polishing pad 104. Polishing pad 104 is configured to connect to platen 102 so that polishing pad 104 rotates in a same direction at a same speed as the platen. In some embodiments where platen 102 is stationary, polishing pad 104 is held stationary. Polishing pad 104 has a textured surface which is configured to remove material from the wafer during operation of CMP system 100.

Polishing head 106 is configured to support the wafer during operation of CMP system 100. In some embodiments, polishing head 106 includes a retaining ring to secure the wafer against the polishing head 106. In some embodiments, polishing head 106 includes a vacuum to secure the wafer against the polishing head 106. Polishing head 106 is configured to rotate in a second direction. In some embodiments, the second direction is the same as the first direction. In some embodiments, the second direction is opposite the first direction. In some embodiments, polishing head 106 is configured to rotate at a constant rotational speed. In some embodiments, polishing head 106 is configured to rotate at a variable rotational speed. In some embodiments, polishing head 106 is rotated by a motor. In some embodiments, the motor is an AC motor, a DC motor, a universal motor, or another suitable motor. In some embodiments, polishing head 106 is held stationary. In some embodiments, polishing head 106 translates relative to polishing pad 104.

Polishing head 106 is configured to move in a direction perpendicular to the surface of polishing pad 104. By moving polishing head 106 in the direction perpendicular to the surface of polishing pad 104, the pressure exerted on the wafer by the polishing pad 104 is adjustable. In some embodiments, polishing head 106 includes pressure sensors to monitor a pressure exerted on the wafer. In some embodiments, the pressure sensors are connected to a control system. In some embodiments, polishing head 106 includes pressure adjustment devices configured to exert force on a surface of wafer opposite polishing pad 104 to adjust the pressure exerted on the wafer at various locations of the wafer. In some embodiments, the pressure adjustment devices include nozzles configured to emit pressurized gas, translatable pins or other suitable force exerting elements.

Conditioner 108 is configured to restore the roughness of polishing pad 104. During operation of CMP system 100, a roughness of polishing pad 104 decreases as a result of the force between the wafer and the polishing pad or through a buildup of slurry or other particles. Conditioner 108 is configured to restore the roughness of polishing pad 104 to maintain effective operation of CMP system 100.

Conditioner 108 includes a conditioner pad **108*a* configured to contact polishing pad 104. In some embodiments, conditioner pad 108*a* is configured to rotate. Conditioner 108 also includes a conditioner arm 108*b* configured to translate conditioner pad 108*a* across the surface of polishing pad 104**.

Slurry delivery system 110 is configured to provide the slurry onto polishing pad 104. In some embodiments, slurry deliver system 110 includes a slurry mixing system configured to mix various fluid compositions prior to delivering the mixture to polishing pad 104. Slurry delivery system 110 includes at least one nozzle **110*a* configured to deliver the slurry to polishing pad 104. Slurry delivery system 110 further includes a delivery arm 110*b* configured to translate a location of nozzle 110*a* relative to the surface of polishing pad 104**.

Sensor 115 is configured to collect information related to the roughness of polishing pad 104. A single sensor 115 is included in FIG. 1 for simplicity. In some embodiments, multiple sensors 115 are included to detect the roughness at different locations on polishing pad 104. In some embodiments, sensor 115 is an integrated array of sensing elements extending across a portion of polishing pad 104. By collecting information on roughness at different locations, sensors 115 would be able to more precisely locate portions of polishing pad 104 having a roughness outside of a threshold range. In some embodiments, sensor 115 is an optical sensor configured to receive light reflected from the surface of polishing pad 104. In some embodiments, sensor 115 is sensitive to visible light. In some embodiments, sensor 115 is sensitive to infrared (IR) light. In some embodiments, each sensor 115 of multiple sensors 115 is a same type of sensor, e.g., visible light detecting sensor. In some embodiments, at least one sensor 115 of multiple sensors 115 is different from another sensor 115, e.g., one sensor 115 is sensitive to visible light and one sensor 115 is sensitive to IR light. In some embodiments, sensor 115 is configured to emit light toward polishing pad 104.

Sensor 117 is configured to receive light originating from sensor 115 that is reflected by polishing pad 104. A single sensor 117 is included in FIG. 1 for simplicity. In some embodiments, multiple sensors 117 are included to detect the roughness at different locations on polishing pad 104. In some embodiments, sensor 117 is an integrated array of sensing elements extending across a portion of polishing pad 104. By collecting information on roughness at different locations, sensors 117 would be able to more precisely locate portions of polishing pad 104 having a roughness outside of a threshold range. In some embodiments, each sensor 115 is paired with a sensor 117. In some embodiments, at least one sensor 115 is a stand-alone sensor that is not paired with a sensor 117. In some embodiments, sensor 117 is an optical sensor configured to receive light reflected from the surface of polishing pad 104. In some embodiments, sensor 117 is sensitive to visible light. In some embodiments, sensor 117 is sensitive to IR light. In some embodiments, each sensor 117 of multiple sensors 117 is a same type of sensor, e.g., visible light detecting sensor. In some embodiments, at least one sensor 117 of multiple sensors 117 is different from another sensor 117, e.g., one sensor 117 is sensitive to visible light and one sensor 117 is sensitive to IR light. In some embodiments, sensor 117 is omitted where every sensor 115 is a stand-alone sensor.

Polishing pad 104 has a radius R extending from the center of the platen to an exterior edge of the platen. In some embodiments, radius R of polishing pad 104 is at least 2.5 times greater than a radius of polishing head 106. If the radius R of polishing pad 104 is less than the 2.5 times greater than the radius of polishing head 106, maintaining a roughness of the polishing pad 104 will be difficult, which increases polishing time and decreases production yield, in some embodiments.

As polishing pad 104 and polishing head 106 rotate, a location of detection point(s) for sensor 115 and/or sensor 117 relative to the polishing pad 104 changes. By using multiple distinct detection points, a more uniform amount of data is collected related to various areas across polishing pad 104. The uniform amount of data enables a more accurate determination of a roughness profile of polishing pad 104. A roughness profile is a variation of roughness across the surface of polishing pad 104. For example, in some embodiments, a region of the polishing pad 104 used most often during the CMP process will have a lowest roughness in some instances.

Controller 120 is configured to receive information from sensor 115. In some embodiments which include sensor 117, controller 120 is configured to receive information from sensor 117. In some embodiments, the information includes an image of the polishing pad 104. In some embodiments, the information includes a signal indicating a roughness of the polishing pad 104. Controller 120 is configured to determine a roughness of polishing pad 104 based on the received information. In some embodiments including multiple sensors 115 and/or sensors 117, controller 120 is configured to determine a roughness profile of polishing pad 104.

Based on the information from the sensor 115 or sensor 117 for polishing pad 104, controller 120 is configured to control conditioner 108. In some embodiments, controller 120 controls a number of iterations of a conditioning process of conditioner 108. Controller 120 is also configured to track the iterations of a conditioning process used on polishing pad 104. In some embodiments, controller 120 is configured to adjust the pressure of conditioner head 108*a* on polishing pad 104. In some embodiments, controller 120 is configured to adjust the location of conditioner head 108*a* based on a determined roughness profile of polishing pad 104. In some embodiments, controller 120 is configured to control a secondary conditioner (not shown) to increase the number of conditioners used to adjust the roughness of polishing pad 104.

Figure 2:
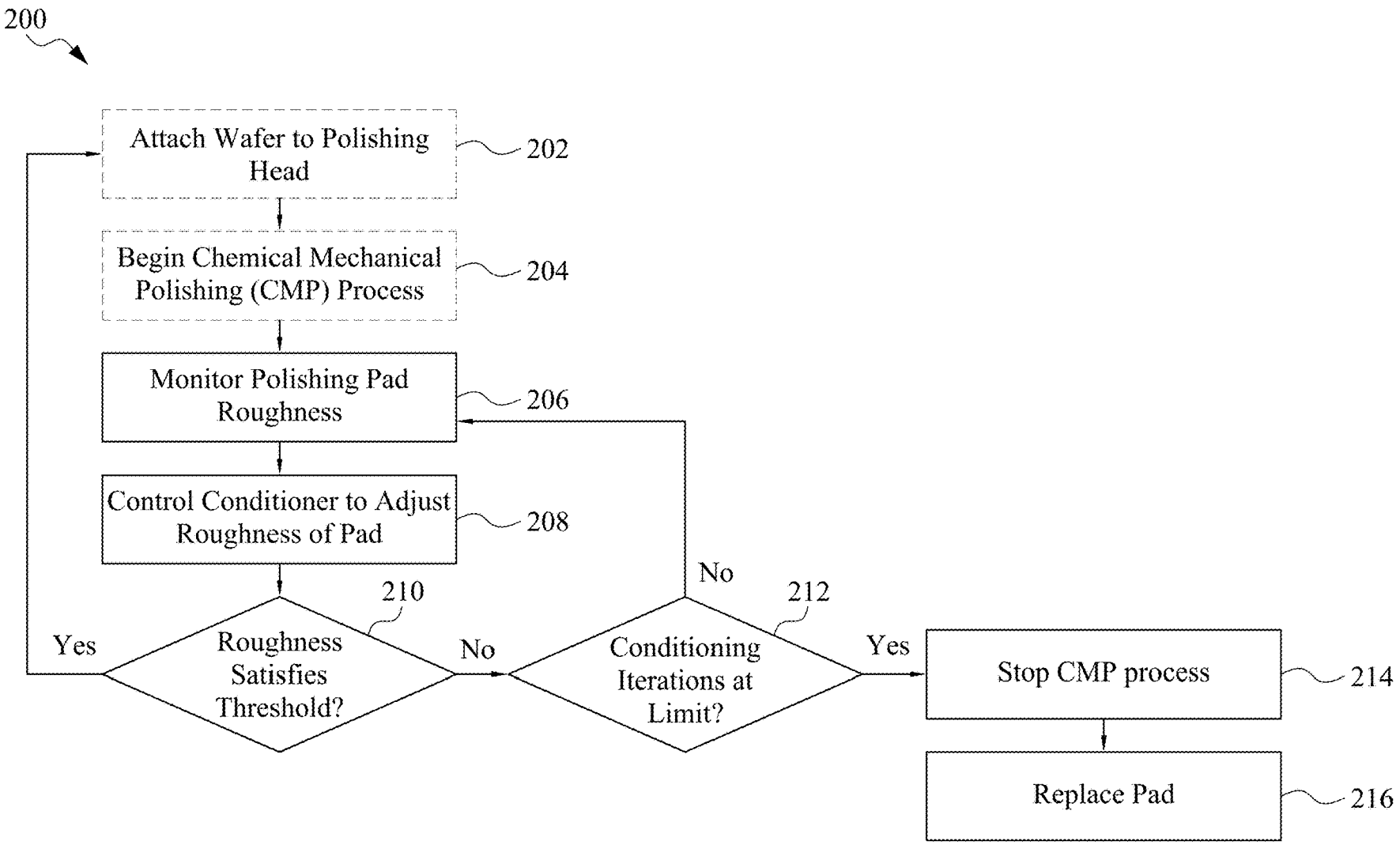
FIG. 2 is a flowchart of a method of using a CMP system in accordance with one or more embodiments.

FIG. 2 is a flowchart of a method 200 of using a CMP system in accordance with one or more embodiments. In operation 202, a wafer is attached to a polishing head. In some embodiments, the wafer is attached to polishing head 106 (FIG. 1). In some embodiments, the wafer is attached to the polishing head using a retaining ring. In some embodiments, the wafer is attached to the polishing head using a vacuum or other suitable attachment element. In some embodiments, operation 202 is omitted. For example, operation 202 is omitted when the operation is implemented by a user or by another device.

In operation 204, a CMP process is begun. The CMP process comprises applying pressure on the wafer against a polishing pad. In some embodiments, the wafer is rotated relative to the polishing pad. In some embodiments, the polishing pad is rotated relative to the wafer. In some embodiments, both the wafer and the polishing pad are rotated. The CMP process also includes applying a slurry to the polishing pad and conditioning the polishing pad to restore a texture of the polishing pad. In some embodiments, the wafer is configured to translate relative to the polishing pad. In some embodiments, the polishing pad is configured to translate relative to the wafer. In some embodiments, operation 204 is omitted. For example, operation 204 is omitted when the operation is implemented by a user or by another device.

In step 206, a roughness of the polishing pad is monitored. In some embodiments, the roughness of the polishing pad is monitored using a single point of detection. In some embodiments, the roughness of the polishing pad is monitored using multiple points of detection. In some embodiments, the roughness of the polishing is monitored using sensor 115 and/or sensor 117 (FIG. 1). In some embodiments, multiple points of detection are used to monitor a roughness profile of the polishing pad. In some embodiments, the roughness of the polishing pad is monitored using reflected light beams.

In step 208, a conditioner of the CMP system is controlled in order to adjust the roughness of the polishing pad. In some embodiments, a number of iterations of the conditioning process is adjusted based on information received from the sensor, e.g., sensor 115 and/or sensor 117 (FIG. 1). In some embodiments, a location of a conditioner head, e.g., conditioner head 108*a* (FIG. 1), is adjusted based on information from the sensor, e.g., sensor 115 and/or sensor 117. In some embodiments, the pressure of a conditioner head, e.g., conditioner head 108*a* (FIG. 1), is adjusted based on information received from the sensor, e.g., sensor 115 and/or sensor 117. In some embodiments, a smooth conditioner is used to reduce a roughness of the polishing pad. In some embodiments, the pressure of the conditioner head is adjusted by moving the conditioner head in the direction perpendicular to the polishing pad. In some embodiments, the movement of the conditioner head occurs during a CMP process. In some embodiments, the movement of the conditioner head occurs after the CMP process. In some embodiments, the conditioner is adjusted to provide a uniform profile on a polished surface of the wafer. In some embodiments, an additional conditioner head is used during a conditioning process. In some embodiments, the additional conditioning head helps to reduce an amount of time for completing the conditioning process. In some embodiments, the additional conditioner head helps to account for variations in the roughness profile in the polishing pad.

In operation 210, the roughness of the polishing pad is compared with a threshold roughness range. In some embodiments, the threshold roughness range is selected by a user. In some embodiments, the threshold roughness range is determined based on empirical data related to performance of the CMP processing. In some embodiments, roughness information is collected after the conditioning process to compare with the threshold roughness range. In some embodiments, the roughness information is collected during the conditioning process. In some embodiments, the roughness is measured at a single location on the polishing pad. In some embodiments, the roughness is measured at multiple locations on the polishing pad.

Method 200 returns to operation 202 in response to the roughness of the polishing pad satisfying the threshold roughness range. In some embodiments, a new wafer is placed on the polishing head in response to method 200 returning to operation 202. In some embodiments, a same wafer on the polishing head undergoes an additional CMP process in response to method 200 returning to operation 202. A decision regarding whether to place a new wafer on the polishing head is based on whether a desired thickness of the polished wafer is achieved. Method 200 proceeds to operation 212 in response to the roughness of the polishing pad failing to satisfy the threshold roughness range. In some embodiments, if the roughness at any single location on the polishing pad fails to satisfy the threshold roughness range, then method 200 proceeds to operation 212. In some embodiments, if the roughness of a first location on the polishing pad fails to satisfy the threshold roughness range, but a second location satisfies the threshold roughness range, then an additional iteration of conditioning is performed only on the failed locations of the polishing pad.

In operation 212, the number of iterations of the conditioning process is compared with an iteration limit. In some embodiments, the iteration limit ranges from about 3 to about 5 iterations. If the number for the iteration limit is too low, then the polishing pad is replaced more frequently, which increases production costs in some instances. If the number for the iteration limit is too high, then extra time is spent attempting to increase the roughness of the polishing pad which reduces production output of the manufacturing process. In some embodiments, the number of iterations is adjusted in response to the conditioning process including multiple conditioners. For example, in some embodiments, if two conditioners are used in the conditioning process, the number of iterations of the conditioning process is increased by two instead of one. In some embodiments, the number of iterations of the conditioning process is determined without consideration of the number of conditioners used in the conditioning process. Method 200 returns to operation 206 in response to the number of iterations being less than the iteration limit. Method 200 proceeds to operation 214 in response to the number of iterations reaching the iteration limit.

In operation 214, the CMP process is stopped. In some embodiments, the CMP process is stopped based on the thickness of the wafer reaching a target thickness. In some embodiments, the CMP process is stopped based on a duration of the CMP process reaching a target duration. In some embodiments, the CMP process is stopped based on the roughness of the polishing pad being unable to properly perform the CMP process.

In operation 216, the polishing pad is replaced. In some embodiments, a user is notified and instructed to replace the polishing pad. In some embodiments, a control signal is transmitted to an automatic system for replacing the polishing pad; and the automatic system replaces the polishing pad without user interaction.

In some embodiments, at least one operation is included in method 200 prior to the described operations. For example, in some embodiments, an initial polishing pad is attached to the platen prior to operation 202. In some embodiments, at least one operation is performed after the described operations. For example, in some embodiments, a conditioner is replaced after the polishing pad is replaced. In some embodiments, at least one operation from method 200 is omitted. For example, in some embodiments, operation 202 is omitted as described above. In some embodiments, an order of operations of method 200 is altered. For example, in some embodiments, operation 208 is performed prior to operation 206. In some embodiments, when operation 208 is performed prior to operation 206 a default conditioning process is performed in a first iteration and the conditioning process is adjusted in subsequent iterations based on the detected roughness of the polishing pad.

Figure 3:
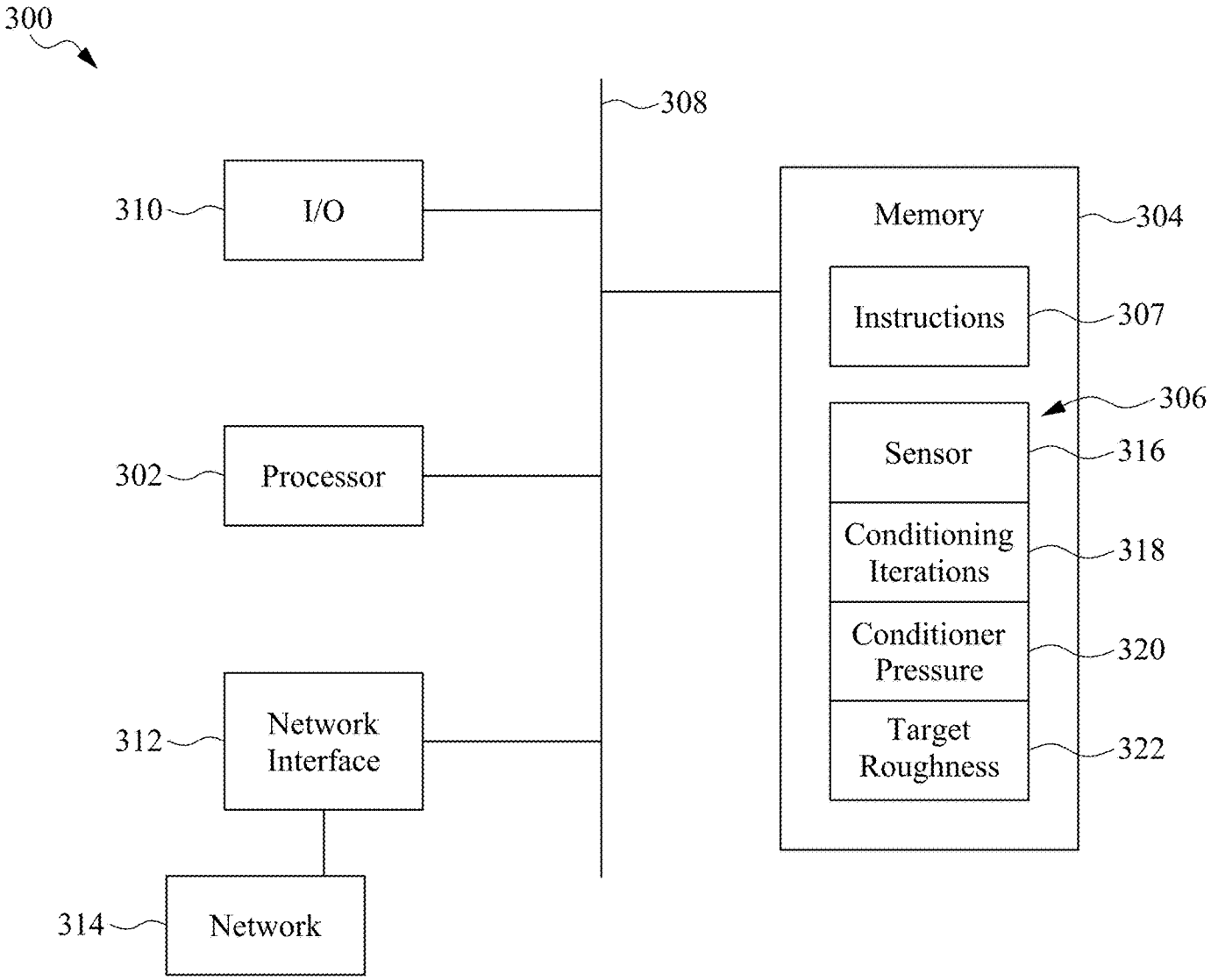
FIG. 3 is a block diagram of a computing device for controlling a CMP system in accordance with one or more embodiments.

FIG. 3 is a block diagram of a computing device 300 for controlling a CMP system in accordance with one or more embodiments. Computing device 300 includes a hardware processor 302 and a non-transitory, computer readable storage medium 304 encoded with, i.e., storing, the computer program code 306, i.e., a set of executable instructions. Computer readable storage medium 304 is also encoded with instructions 307 for interfacing with elements of CMP system 100. The processor 302 is electrically coupled to the computer readable storage medium 304 via a bus 308. The processor 302 is also electrically coupled to an I/O interface 310 by bus 308. A network interface 312 is also electrically connected to the processor 302 via bus 308. Network interface 312 is connected to a network 314, so that processor 302 and computer readable storage medium 304 are capable of connecting to external elements via network 314. The processor 302 is configured to execute the computer program code 306 encoded in the computer readable storage medium 304 in order to cause computing device 300 to be usable for performing a portion or all of the operations as described with respect to CMP system 100.

In some embodiments, the processor 302 is a central processing unit (CPU), a multi-processor, a distributed processing system, an application specific integrated circuit (ASIC), and/or a suitable processing unit.

In some embodiments, the computer readable storage medium 304 is an electronic, magnetic, optical, electromagnetic, infrared, and/or a semiconductor system (or apparatus or device). For example, the computer readable storage medium 304 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 304 includes a compact disk-read only memory (CD-ROM), a compact disk-read/write (CD-R/W), and/or a digital video disc (DVD).

In some embodiments, the storage medium 304 stores the computer program code 306 configured to cause computing device 300 to perform the operations as described with respect to CMP system 100. In some embodiments, the storage medium 304 also stores information needed for performing the operations as described with respect to CMP system 100, such as a sensor parameter 316, a conditioning iterations parameter 318, a conditioner pressure parameter 320, a target roughness parameter 322 and/or a set of executable instructions to perform the operation as described with respect to CMP system 100.

In some embodiments, the storage medium 304 stores instructions 307 for interfacing with CMP system 100. The instructions 307 enable processor 302 to generate operating instructions readable by elements of the CMP system 100 to effectively implement the operations as described with respect to CMP system 100.

Computer device 300 includes I/O interface 310. I/O interface 310 is coupled to external circuitry. In some embodiments, I/O interface 310 includes a keyboard, keypad, mouse, trackball, trackpad, and/or cursor direction keys for communicating information and commands to processor 302.

Computing device 300 also includes network interface 312 coupled to the processor 302. Network interface 312 allows computing device 300 to communicate with network 314, to which one or more other computer systems are connected. Network interface 312 includes wireless network interfaces such as BLUETOOTH, WIFI, WIMAX, GPRS, or WCDMA; or wired network interface such as ETHERNET, USB, or IEEE-1394. In some embodiments, the operations as described with respect to CMP system 100 are implemented in two or more computing devices 300, and information such as sensor information, conditioning iterations information, conditioner pressure and target roughness are exchanged between different computing devices 300 via network 314.

Computing device 300 is configured to receive information related to the sensor, e.g., sensor 115 and/or sensor 117 (FIG. 1), through I/O interface 310. The information is transferred to processor 302 via bus 308 to determine the roughness of the polishing pad at the sensor location. The roughness and/or profile are then stored in computer readable medium 304 as sensor parameter 316. Computing device 300 is configured to receive information related to the conditioning iterations through I/O interface 310. The information is transferred to processor 302 via bus 308 to determine the number of conditioning iterations. The number of conditioning iterations are then stored in computer readable medium 304 as conditioning iterations parameter 318. Computing device 300 is configured to receive information related to conditioner pressure through I/O interface 310. In some embodiments, the pressure information is provided by pressure sensors located in the conditioning head. The information is stored in computer readable medium 304 as conditioner pressure parameter 320. Computing device 300 is configured to receive information related to target roughness through I/O interface 310. In some embodiments, the target roughness information is received from an operator. In some embodiments, the target roughness is calculated based on information received by computing device 300 related to a manufacturing process. The information is stored in computer readable medium 304 as target roughness parameter 322.

During operation, in some embodiments, processor 302 executes a set of instructions to determine whether to perform another iteration of a conditioning process using the conditioner based on sensor parameter 316, conditioning iterations parameter 318 and target roughness parameter 322. During operation, processor 302 executes a set of instructions to determine whether the roughness of the polishing pad is within a threshold range based on sensor parameter 316 and target roughness parameter 322. Based on the above determinations, processor 302 generates a control signal to instruct the conditioner to perform another conditioning process. In some embodiments, the control signal is transmitted using I/O interface 310. In some embodiments, the control signal is transmitted using network interface 312.

During operation, in some embodiments, processor 302 executes a set of instructions to determine whether to adjust the pressure of the conditioner based on sensor parameter 316, conditioner pressure parameter 320 and target roughness parameter 322. During operation, processor 302 executes a set of instructions to determine whether the roughness of the polishing pad is within a threshold range based on sensor parameter 316 and target roughness parameter 322. Based on the above determinations, processor 302 generates the pressure adjustment signal to adjust the position of the conditioner head. In some embodiments, the pressure adjustment signal is transmitted using I/O interface 310. In some embodiments, the pressure adjustment signal is transmitted using network interface 312.

During operation, in some embodiments, processor 302 executes a set of instructions to determine whether to adjust the location of the conditioner based on sensor parameter 316 and target roughness parameter 322. During operation, processor 302 executes a set of instructions to determine whether the roughness of the polishing pad is within a threshold range at various locations across the polishing pad based on sensor parameter 316 and target roughness parameter 322. Based on the above determinations, processor 302 generates conditioner location adjustment signal to adjust the position of the conditioner head on the polishing pad. The position of the conditioner head is adjustable in a direction perpendicular to the polishing pad to adjust the pressure exerted on the polishing pad; or in a direction parallel to a top surface of the polishing pad to condition a different zone of the polishing pad. In some embodiments, the conditioner location adjustment signal is transmitted using I/O interface 310. In some embodiments, the conditioner location adjustment signal is transmitted using network interface 312.

One aspect of this description relates to a method of conditioning a polishing pad. The method includes receiving information on a roughness of the polishing pad from a first sensor. The method further includes conditioning the polishing pad using a conditioner. The method further includes detecting the roughness of the polishing pad following the conditioning. The method further includes repeating the conditioning in response to the detected roughness of the polishing pad being outside of a threshold roughness range. In some embodiments, the method further includes tracking a number of iterations of the conditioning; and outputting a signal for replacing the polishing pad in response to the number of iterations reaching an iteration limit. In some embodiments, the method further includes receiving information on the roughness of the polishing pad from a second sensor, wherein the second sensor is configured detect the roughness at a location different from the first sensor; and determining a roughness profile of the polishing pad based on the information received from the first sensor and the second sensor. In some embodiments, the method further includes adjusting a location of the conditioner relative to the polishing pad based on the determined roughness profile. In some embodiments, adjusting the location of the conditioner includes moving the conditioner in a direction parallel to a top surface of the polishing pad. In some embodiments, the method further includes adjusting a pressure exerted on the polishing pad by the conditioner based on information received from the first sensor. In some embodiments, adjusting the pressure includes moving the conditioner in a direction perpendicular to a top surface of the polishing pad. In some embodiments, conditioning the polishing pad includes conditioning the polishing pad during a chemical mechanical polishing (CMP) process. In some embodiments, conditioning the polishing pad includes conditioning the polishing pad after a CMP process. In some embodiments, receiving the information on the roughness includes receiving the information on the roughness during a CMP process.

One aspect of this description relates to a chemical mechanical polishing (CMP) system. The CMP system includes a polishing pad configured to polish a wafer. The CMP system further includes a first sensor configured to detect a roughness of the polishing pad. The CMP system further includes a conditioner configured to adjust the roughness of the polishing pad. The CMP system further includes a controller configured to control the conditioner based on information received from the first sensor, wherein the controller is configured to control a number of iterations of a conditioning process performed by the conditioner on the polishing pad. In some embodiments, the first sensor is an optical sensor. In some embodiments, the CMP system further includes a second sensor configured to detect the roughness of the polishing pad, wherein the second sensor positioned over a different portion of the polishing pad than the first sensor. In some embodiments, the controller is configured to determine a roughness profile of the polishing pad based on information from the first sensor and from the second sensor. In some embodiments, the controller is configured to control the conditioner based on the determined roughness profile. In some embodiments, the controller is configured to control a location of the conditioner relative to the polishing pad based on the determined roughness profile. In some embodiments, the controller is configured to control a pressure exerted on the polishing pad by the conditioner based on the information received from the first sensor. In some embodiments, the controller is configured to track the number of iterations of the conditioning process.

One aspect of this description relates to a chemical mechanical polishing (CMP) system. The CMP system includes a polishing head configured to hold a wafer during a CMP process. The CMP system includes a polishing pad configured to polish the wafer. The CMP system further includes a plurality of sensors configured to detect a roughness of the polishing pad. The CMP system further includes a conditioner configured to adjust the roughness of the polishing pad. The CMP system further includes a controller configured to control the conditioner based on information received from the plurality of sensors. The controller is configured to control a number of iterations of a conditioning process performed by the conditioner on the polishing pad, control a location of the conditioner relative to the polishing pad, or control a pressure exerted on the polishing pad by the conditioner. In some embodiments, a first sensor of the plurality of sensors is configured to emit light toward the polishing pad, and a second sensor of the plurality of sensors is configured to receive the emitted light reflected from the polishing pad. The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method of conditioning a polishing pad comprising:

performing a chemical mechanical polishing (CMP) process using the polishing pad;

receiving information on a roughness of the polishing pad from a first sensor;

conditioning the polishing pad using a conditioner;

detecting the roughness of the polishing pad following the conditioning;

tracking a number of iterations of the conditioning; and outputting a signal for replacing the polishing pad in response to the number of iterations reaching an iteration limit; and repeating the conditioning in response to the detected roughness of the polishing pad being outside of a threshold roughness range, wherein repeating the conditioning comprises continuing the CMP process during the repeating the conditioning.

2. The method of claim 1, wherein outputting the signal for replacing the polishing pad comprises outputting the signal in response to the number of iterations exceeding a value ranging from 3 to 5.

3. The method of claim 1, further comprising:

receiving information on the roughness of the polishing pad from a second sensor, wherein the second sensor is configured detect the roughness at a location different from the first sensor; and determining a roughness profile of the polishing pad based on the information received from the first sensor and the second sensor.

4. The method of claim 3, further comprising adjusting a location of the conditioner relative to the polishing pad based on the determined roughness profile.

5. The method of claim 4, wherein adjusting the location of the conditioner comprises moving the conditioner in a direction parallel to a top surface of the polishing pad.

6. The method of claim 1, further comprising adjusting a pressure exerted on the polishing pad by the conditioner based on information received from the first sensor.

7. The method of claim 6, wherein adjusting the pressure comprises moving the conditioner in a direction perpendicular to a top surface of the polishing pad.

8. The method of claim 1, wherein conditioning the polishing pad comprises conditioning the polishing pad during a chemical mechanical polishing (CMP) process.

9. The method of claim 1, wherein conditioning the polishing pad comprises conditioning the polishing pad after a CMP process.

10. The method of claim 1, wherein receiving the information on the roughness comprises receiving the information on the roughness during a CMP process.

11. A chemical mechanical polishing (CMP) system comprising:

a polishing pad configured to polish a wafer;

a first sensor configured to detect a roughness of the polishing pad;

a conditioner configured to adjust the roughness of the polishing pad; and a controller configured to control the conditioner based on information received from the first sensor, wherein the controller is configured to:

track a number of iterations of a conditioning process performed by the conditioner on the polishing pad, and generate a signal for replacing the polishing pad in response to the number of iterations reaching an iteration limit.

12. The CMP system of claim 11, wherein the first sensor is an optical sensor.

13. The CMP system of claim 11, further comprising a second sensor configured to detect the roughness of the polishing pad, wherein the second sensor positioned over a different portion of the polishing pad than the first sensor.

14. The CMP system of claim 13, wherein the controller is configured to determine a roughness profile of the polishing pad based on information from the first sensor and from the second sensor.

15. The CMP system of claim 14, wherein the controller is configured to control the conditioner based on the determined roughness profile.

16. The CMP system of claim 15, wherein the controller is configured to control a location of the conditioner relative to the polishing pad based on the determined roughness profile.

17. The CMP system of claim 11, wherein the controller is configured to control a pressure exerted on the polishing pad by the conditioner based on the information received from the first sensor.

18. The CMP system of claim 11, wherein the controller is configured to track the number of iterations of the conditioning process.

19. A chemical mechanical polishing (CMP) system comprising:

a polishing head configured to hold a wafer during a CMP process;

a polishing pad configured to polish the wafer;

a plurality of sensors configured to detect a roughness of the polishing pad;

a conditioner configured to adjust the roughness of the polishing pad; and a controller configured to control the conditioner based on information received from the plurality of sensors, wherein the controller is configured to:

track a number of iterations of the conditioning;

output a signal for replacing the polishing pad in response to the number of iterations reaching an iteration limit, control a location of the conditioner relative to the polishing pad, and control a pressure exerted on the polishing pad by the conditioner.

20. The CMP system of claim 19, wherein a first sensor of the plurality of sensors is configured to emit light toward the polishing pad, and a second sensor of the plurality of sensors is configured to receive the emitted light reflected from the polishing pad.

* * * * *